United States Patent [19]

Oller

[11] Patent Number: 4,729,199

[45] Date of Patent: Mar. 8, 1988

[54] SNOW SLIDE KIT

[76] Inventor: Frank G. Oller, P.O. Box 107, Macks Inn, Id. 83433

[21] Appl. No.: 838,695

[22] Filed: May 8, 1986

[51] Int. Cl.[4] ..... E04H 9/16; E01H 5/02; E01H 5/12

[52] U.S. Cl. ..... 52/173 R; 37/196; 37/285; 52/24

[58] Field of Search ..... 52/24, 25, 26, 23, 173 R; 37/196, 285

[56] References Cited

U.S. PATENT DOCUMENTS

| | | | |
|---|---|---|---|
| 352,424 | 11/1886 | Owen et al. | 52/23 |
| 3,091,790 | 6/1963 | Schroeder | 15/105 |
| 3,416,266 | 12/1968 | Eron | 52/25 X |
| 3,608,253 | 9/1971 | Theriault | 52/24 |
| 3,998,486 | 12/1976 | Mittelstadt | 37/130 X |
| 4,249,767 | 2/1981 | Andreasen | 37/266 X |
| 4,386,474 | 6/1983 | Mechavich et al. | 37/285 |

FOREIGN PATENT DOCUMENTS

| | | | |
|---|---|---|---|
| 26329 | 11/1906 | Austria | 52/25 |

*Primary Examiner*—Alfred C. Perham

*Attorney, Agent, or Firm*—Hopkins, French, Crockett, Springer & Hoopes

[57] ABSTRACT

An apparatus is disclosed for the removal of accumulated snow loads from roofs. The apparatus comprises a plurality of upper and lower brackets affixable to a planar roof surface in spaced configuration thereon. Each bracket has one or more slots capable of receiving and retaining a wire. Actuation of the system by pulling a wire causes the wire to be released from the upper brackets, and to slice through an accumulated snow load, breaking the seal between the snow and the roof and resulting in the snow sliding off the roof.

6 Claims, 4 Drawing Figures

SNOW SLIDE KIT

BACKGROUND OF THE INVENTION

This invention relates to a system for the removal of snow from roofs, in particular sloping roofs of residential or commercial buildings. In heavy snowfall areas it is desirable to remove large snow accumulations from roofs for structural reasons. It is also desirable to remove such snow at a predetermined time to avoid snow slides onto pedestrians walking beneath the roof. There are known methods of snow removal from roofs, including methods involving some use of wires, but these generally all involve installation or operation at least in part by humal physical presence on the roof, which in winter conditions is hazardous, both to the user and to other persons who may be in the path of the resultant snow slide. Alternative methods such as shovelling and scraping, are likewise unsuitable.

In order to alleviate these problems, the present invention comprises a system for snow removal from roofs wherein upper and lower brackets are affixed to a planar roof surface in a spaced configuration thereon, each bracket having at least one slot capable of receiving and releasably retaining a wire having associated therewith wire retaining means and wire releasing means. The arrangement is such that, on operation of the wire releasing means, the wire is capable of slicing through an accumulated snow load so as to break the seal between the snow and roof, thereby permitting the snow to slide off.

The apparatus of the present invention thus provides a means of snow removal which can be operated by the user from ground level, at a pre-selected time, thus reducing the risk of accidental injury to the user or others. The system is adapted to be installed in safe weather conditions before winter, and thus be ready for operation at any time thereafter.

As indicated above, the system includes brackets which are affixable to a roof, each bracket having at least one slot which is capable of receiving a wire. The wires are securely retained in the slot or slots of a first principal bracket, but can be drawn through slots in a pair of upper brackets and be released therefrom when desired, by a releasing means associated with a second lower bracket. The operation of releasing the wire effects a cutting action on accumulated snow and ice leading to activation of a slide thereof from the roof surface.

The system is simple and easy for the homeowner or other user to install and use and can be manufactured inexpensively. The cost to the user is further reduced by the capability for regular reuse, including by removal and reinstallation at different locations. The system has the further advantage of being readily adaptable to numerous styles of roof of varying pitch and with or without projections such as vents, chimneys, etc.

BRIEF DESCRIPTION OF THE DRAWINGS

The invention and its operation will be more readily understood by reference to the following drawings in which.

DETAILED DESCRIPTION OF THE INVENTION

Figure 1:
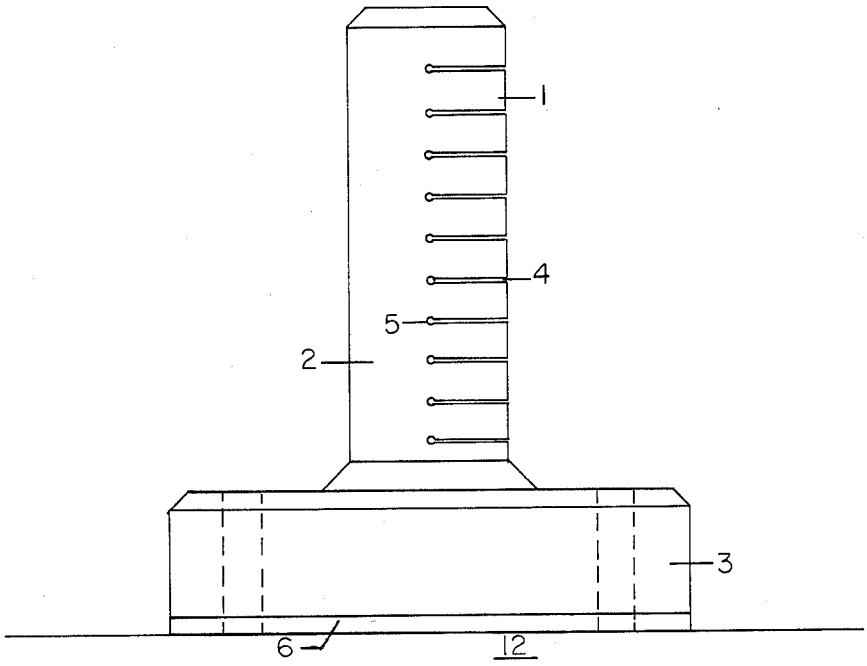
FIG. 1 is a front view of a bracket of an embodiment of the invention.

Referring to FIG. 1, a bracket 1 of the invention comprises a base 3, by means of which the brackets 1 are affixed to a roof 12 (see FIG. 2), and an upper portion 2 into which a plurality of parallel slots 4 have been provided. Each slot 4 has an enlarged portion 5 at the inner end thereof to retain a wire 11. The slots 4 are sized such that they resist movement of the wire therethrough, in order to prevent inadvertent release, but are sufficient to permit the wire to exit when sufficient force is applied.

On each separate planar area of roof to be provided with this invention, two lower brackets 1A, 1B, are mounted, preferably at lower corners of the roof 12. These brackets 1A and 1B are mounted by any suitable means such as lag bolts or screws, with the slots 4 preferably facing outwardly away from the center of the roof and away from each other, so as to retain the wires 11 when the system is activated. The wire must be securely retained in bracket 1A by any convenient means so that there is an anchor point from which the wire may be pulled.

Upper brackets 1C and 1D are secured to selected points on the roof 12, the slots of such brackets preferably facing towards the center of the roof, thereby permitting the wires to be pulled from the brackets and allowing them to sweep across the roof surface. The upper brackets 1C and 1D are mounted in sufficient number to enable adequate coverage of the roof by wires 11, depending on the size and configuration of the roof surface.

Figure 2:
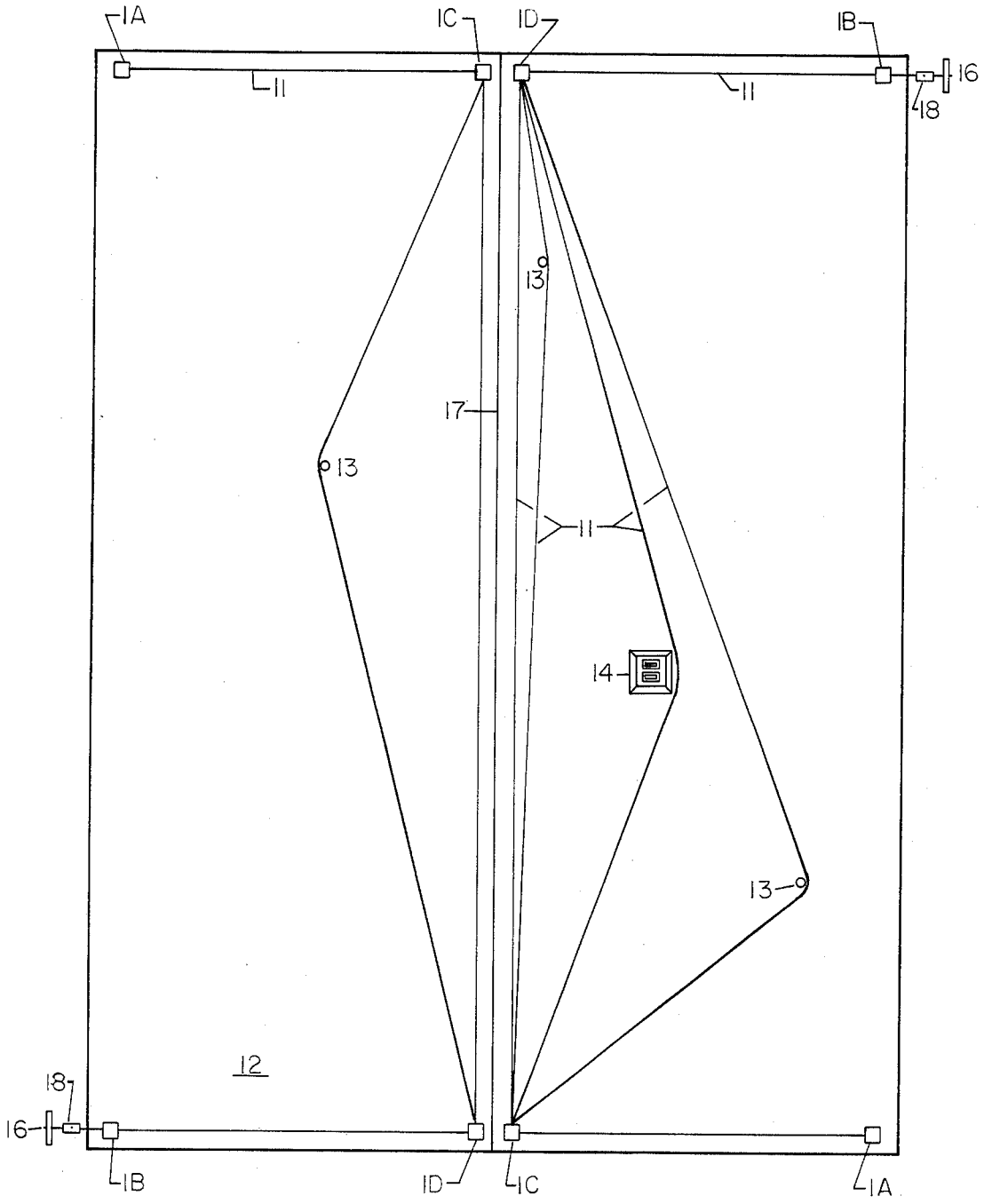
FIG. 2 is a plan view of the roof showing a typical mounting pattern of the system.

FIG. 2 shows a typical pattern of mounting the invention on a typical roof surface, illustrating that the wires 11 can be mounted so as to avoid obstacles such as vents 13, 13', and chimney 14. Brackets may or may not be used when avoiding such obstacles, depending upon the particular circumstances, or the wires may simply be looped around the ower edge of each of the roof-mounted obstacles.

Figure 3:
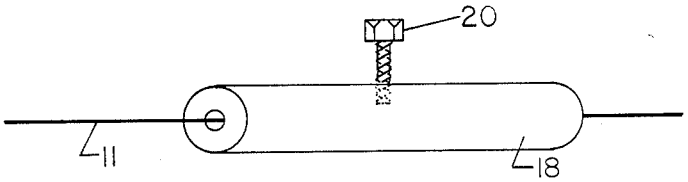
Figure 4:
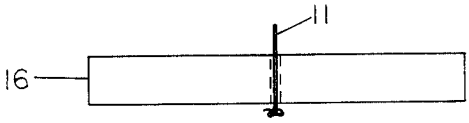

In installing the wires 11, each wire 11 is first locked or anchored securely in place on first lower bracket 1A, and then threaded in succession through each upper bracket 1C and 1D and around any obstacles, in the selected pattern, and finally through the second lower bracket 1B. The wire should be slideably retained within bracket 1B. It has been found desirable to provide a handle (16) of some sort with each wire 11 outside of bracket 1B. When pulling the wire during operation of this invention, a handle affixed thereto affords greater pulling strength to effect dislocation of the snow load. Steel sleeves 18 (as shown in FIG. 3) can be affixed to wires 11 below both lower brackets 1A and 1B with thumb screw 20 to prevent the wires from being pulled upwardly through brackets 1A and 1B.

When a sufficient quantity of snow has accumulated on the roof to initiate activation of this system, the handle of a wire 11 is pulled from below bracket 1B. Because all of the brackets above brackets 1A and 1B face inwardly, when the handle is pulled the wire 11 will release from all upper brackets while being retained within lower brackets 1A and 1B, and as it is pulled downwardly, it will slice through the accumulated snow and ice, breaking the seal between the snow and the roof 12, thus causing the snow to slide off.

If several wires 11 have been installed across the same pattern (utilizing a plurality of the slots 4 in each bracket 1), one wire can be released at a time, so that during the course of a winter, snow can be cleared from the roof several times without the need for any additional installation during the winter. In summer, the entire system can be removed, or can be left in place and re-wired for the following winter.

In installing several wires 11 at the same time, the wires should be kept separate for ease of installation by the use of a wire holder (not shown) having the same configuration as the upper portion 2 ofthe brackets 1. The system can be manufactured simply, of any materials suitable to outdoor use. As the components can be reused for many years, they should all be corrosion proof. A suitable material for the brackets, holder and handle is aluminum bar stock. Other variations of materials and of detailed construction of the components of the system are possible, without departing from the spirit of the invention.

I claim:

1. An apparatus especially adapted to effect removal of a snow load adhering to a planar roof surface, comprising;

a. a plurality of upper and lower brackets adapted to be securely affixed to said roof surface in a spaced apart configuration thereon, each of said brackets having at least one wire-retaining slot therein, and b. said lower brackets securely retaining a wire within said wire-retaining slot and said upper brackets releasably retaining a wire therein, whereby, when said wire is pulled downwardly from one of said lower brackets, said wire releases from said upper brackets and sweeps downwardly across the roof surface thereby breaking the adhesion between said snow load and said roof such that said snow load slides off of said roof.

2. The apparatus as recited in claim 1, wherein a plurality of wires are affixed to said brackets, permitting a plurality of snow loads to be periodically removed from said roof.

3. The apparatus as recited in claim 1, wherein said wires are fixedly retained within a first lower bracket and said wires are slidably retained within a second lower bracket.

4. The apparatus as recited in claim 3, wherein said wire is pulled downwardly from said second lower bracket.

5. The apparatus as recited in claim 1, wherein said wire retaining slots of said lower brackets are adapted to face outwardly away from said roof.

6. The apparatus as recited in claim 1, wherein said wire retaining slots of said upper brackets are adapted to face inwardly toward said roof.

* * * * *